United States Patent [19]

Franz

[11] 4,037,572

[45] July 26, 1977

[54] PAIRED PISTON ENGINE WITH ROTARY VALVES

[76] Inventor: Dennis LaVerne Franz, Rte. 1, Box 1198-B, Selah, Wash. 98942

[21] Appl. No.: 709,495

[22] Filed: July 28, 1976

[51] Int. Cl.[2] ..... F02B 75/02

[52] U.S. Cl. ..... 123/64; 123/51 AA; 123/75 B

[58] Field of Search ..... 123/64, 51 AA, 51 R, 123/75 B, 32 ST

[56] References Cited

U.S. PATENT DOCUMENTS

| | | | |
|---|---|---|---|
| 1,315,954 | 9/1919 | Frazier | 123/64 |
| 1,514,280 | 11/1924 | Girvin | 123/51 AA |
| 1,837,870 | 12/1931 | Johnston | 123/51 AA |
| 2,334,917 | 11/1943 | Ford | 123/51 AA |
| 2,387,843 | 10/1945 | Gray | 123/51 AA |
| 2,420,136 | 5/1947 | Hill | 123/64 |
| 3,948,227 | 4/1976 | Guenther | 123/75 B |

FOREIGN PATENT DOCUMENTS

| | | | |
|---|---|---|---|
| 39,845 | 1/1970 | Japan | 123/64 |
| 39,847 | 6/1970 | Japan | 123/64 |
| 326,962 | 3/1930 | United Kingdom | 123/64 |

*Primary Examiner*—Wendell E. Burns

[57] ABSTRACT

A paired piston engine has a rotary valve positioned above and transversely to the cylinders. The rotor of each rotary valve unit has three passages associated with three ports in the pressure pieces at the sides of the rotors. One passage/port arrangement opens and closes the intake. A second passage/port arrangement opens and closes the exhaust. The third passage/port arrangement opens and closes a second exhaust or second intake. As a result, the engine is a six cycle engine (third passage/port as a second exhaust) or a stratified charge engine (third passage/port as a stratified charge intake).

16 Claims, 18 Drawing Figures

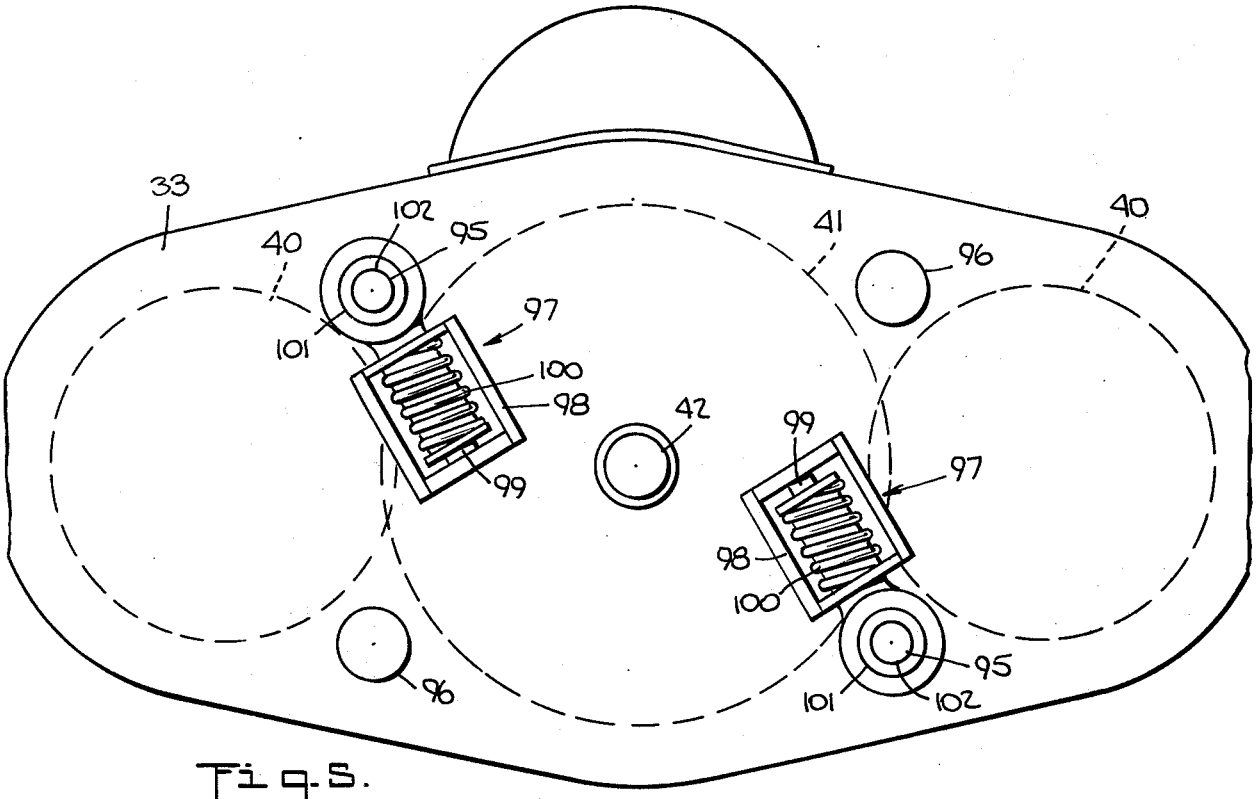
Fig. 5.
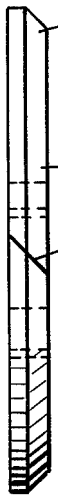
Fig. 9.
Fig. 10.
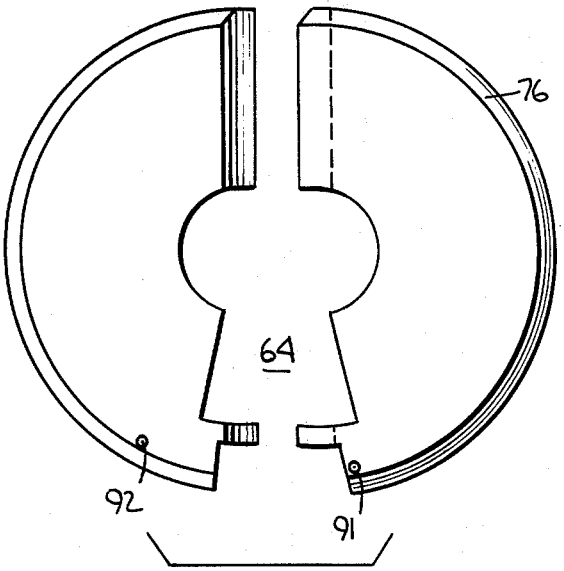
Fig. 11.
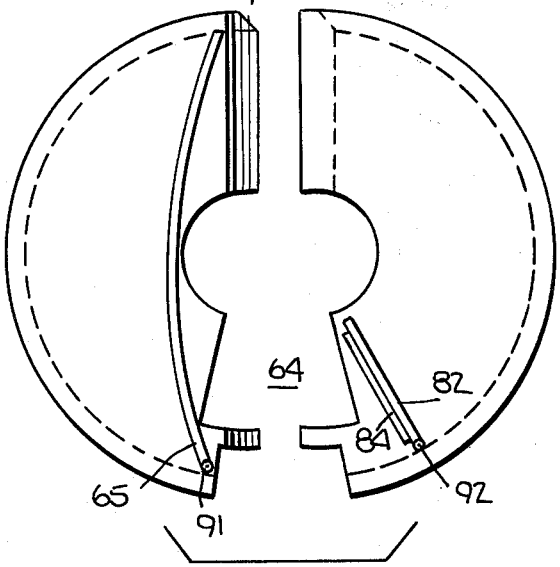

Fig. 15.
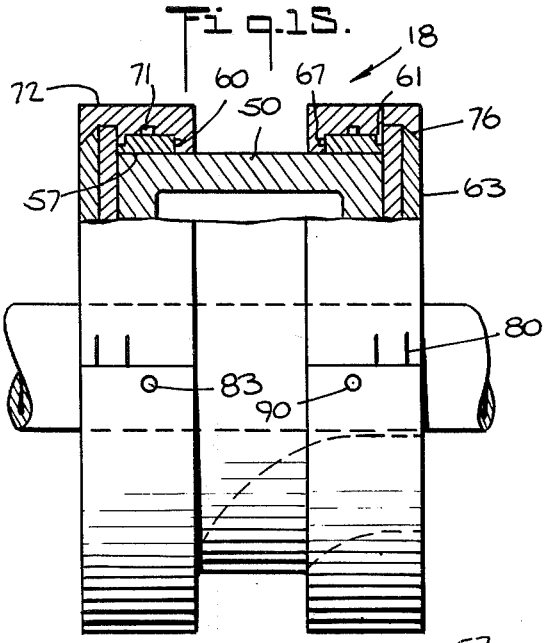
Fig. 16.
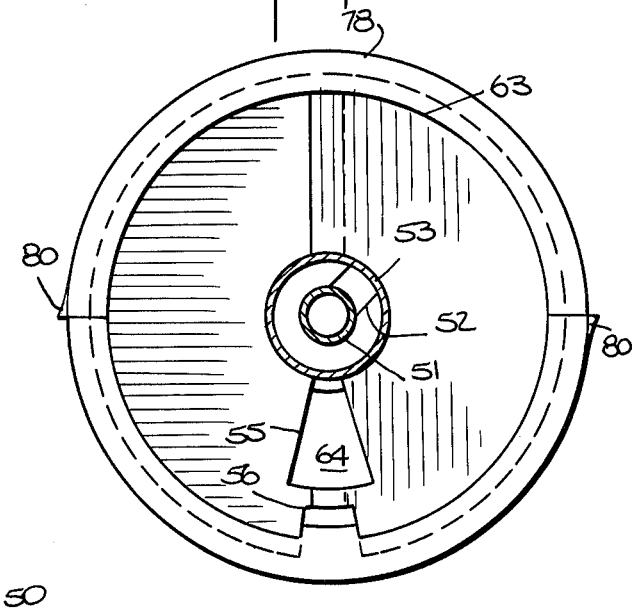
Fig. 18.
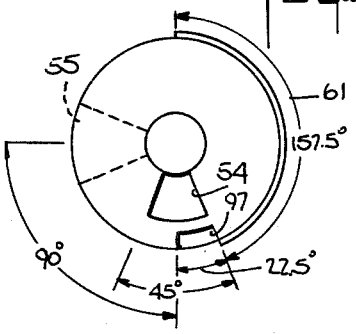
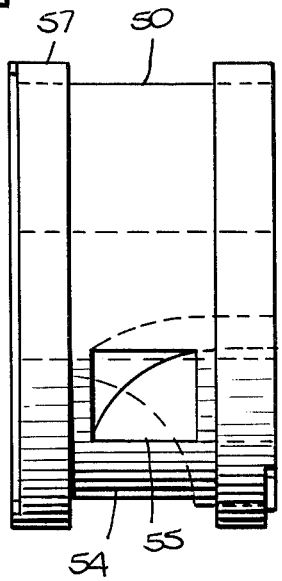
Fig. 6.
Fig. 7.
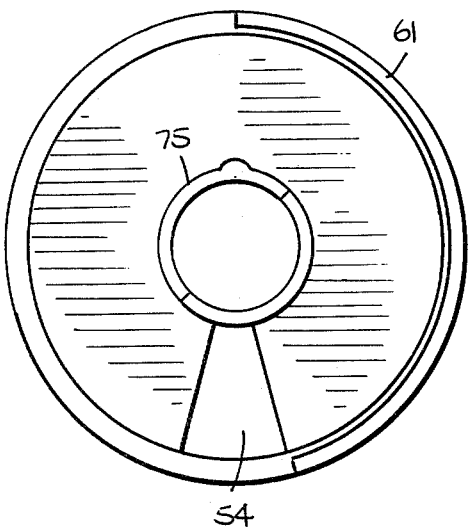
Fig. 8.
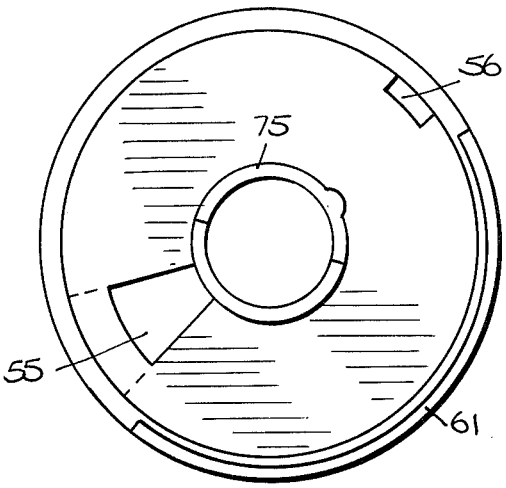

PAIRED PISTON ENGINE WITH ROTARY VALVES

BACKGROUND OF THE INVENTION

In a paired piston engine each cylinder contains two pistons opposing each other and sharing the same combustion chamber. These two pistons are then working on the same combustion chamber at the same time, reducing the need for a large heavy block. To make this feature work two crankshafts geared together with a central idle gear and shaft are incorporated with the pistons. In different configurations such as two cyliners with four pistons of four cylinders with eight pistons, or diesel or fuel injected, the engine is a potentially light, small, very powerful power plant.

However, the paired piston configuration which has been designed under a four cycle sequence has presented problems unacceptable to the present engine standards. The high rpm of a four cycle approach to obtain equal horsepower increases maintenance costs. Also, because of the rapid expansion of the combustion chamber, due to the larger mixture charge to achieve it, a 4 cycle sequence produces a fuel useage greater than convential cylinders along with an unacceptable emission output.

Rotary valves have been the object of study for many years without success because their design has not accommodated the various environmental problems they encounter. These problems relate to the inability to achieve proper cooling, sealing, lubrication and protection against wear and corrosion.

SUMMARY OF THE INVENTION

Accordingly, it is an object of this present invention to provide a paired piston engine which is small, light and very powerful, which overcomes the disadvantages in reliability, fuel useage and unacceptable emission levels previously encountered in paired piston engines.

Another object of this invention is to provide a paired piston engine which operates as a six cycle sequence.

A further object of this invention is to provide a paired piston engine which can accommodate a stratified fuel charge.

These objectives are accomplished in the present invention by a paired piston engine in which rotary valves are located in the center and on top of the engine block. Thus there is no need for a cylinder head, which reduces the size and weight of the engine beyond the reductions theoretically possible with the paired piston design. The block then incorporates the forces and functions of a cylinder head. The small stature and light weight of the engine allows it to be used in a large number of configurations. and applications.

With this engine design and with the rotary valve, we obtain a 6 cycle rather than a 2 or 4 cycle configuration.

This means that the combustion chamber fires twice for every one intake and exhaust stroke. This is possible because the two pistons are moving away from each other upon combustion at twice the rate at the same rpm of the crankshaft as a piston moves away from the head in a regular engine. In other words, the combustion area expands twice as fast at the same crankshaft rpm. This results in a much cooler combustion temperature.

At the very bottom of the first firing stroke after primary combustion of the pistons, a small amount of gas is let out of the chamber to insure the fire is out and to reduce compression on the next secondary compression stroke. This is done by the rotary valve principle by a small third port. The intake and exhaust ports of the rotary valve have a 30° opening angle because the rotary valve rotates at a third of the rmp of the crank shaft.

This heated gas with its adjusted pressure in the chamber is compressed again and fired. All the fuel and oxygen was not used in the primary firing as has been shown by conventional engine exhaust analysis and even more so in the paired piston arrangement because of the rapid decompression. Then the fifth and sixth strokes are completed and the process repeated starting with the intake stroke.

The result of this combustion process then is fuel economy in relation to horespower. It also results in a clean exhaust with few nitrogen oxides because of the low combustion temperature and a low percentage of carbon monoxide because of the secondary combustion.

The paired piston engine design provides an opportunity to combine two functions for the coordinating crankshaft gears. These functions include synchronization of the crankshafts and performing as a hydraulic pump.

The volume and pressure on the hydraulic oil would be dependent upon the number and depth of the teeth on the gears as well as their gear ratio. The values of the volume and pressure are dependent upon the work load to be performed. The housing around the gears serve as seals and contain two input and output ports located around the central gear and between the crankshaft gears. This pressurized oil can be used in a number of ways, including driving the wheels hydraulically.

BRIEF DESCRIPTION OF THE DRAWING FIGURES

The detailed description that follows does not cover in detail the pistons, connecting rods, or crankshafts since the state of the art of these components is well known and does not need to be repeated in detail. The pistons are formed and contoured at their face to minimize detonation, provide the lower part of the combustion chamber, and prevent burning. Because of the short stroke of the pistons, the connecting rods are shortened, eliminating some weight and giving smaller overall dimension.

Except as indicated, the drawings shown are for the six cycle sequence with the turbocharged system.

FIG. 1 is a view looking down upon the engine with half of the engine cut away showing the piston arrangement and the gearing. It also shows the position of the rotary valve and the primary and secondary exhaust exit ports along with the intake ports. The drawing also shows the cooling chamber next to the gears which will help in holding proper temperature for them as well as the engine block. Also shown between the cylinders are oil return holes coming from the valve pressure plates.

FIG. 2 is a view of the front of the engine with the engine cut along one half of a cylinder. This exposes the piston arrangement along with the fresh air ports in the cylinders. The rotary valve is shown with both exhaust ports and intake port for clarity and relationship. It should also be understood that the air ducts shown are connected to the turbocharger discharge.

FIG. 3 is a side view of the engine with part of the engine cut away along with a part of the front of the engine exposed showing the distributor gear and fuel pump cam. Shown in the secondary exhaust chamber is the small primary exhaust chamber or port. Also shown are the cooling jackets and hydraulic synchronization gears.

FIG. 5 is a view of the rear of the engine showing the hydraulic ports and dampers thereon.

FIGS. 6, 7, and 8 show end, intake side and exhaust side respectively of the rotor with its attached rings and the relationship between the oil grooves of the ring and rotor ports.

FIGS. 9, 10, and 11 show end, front and back views respectively of the exhaust pressure plate with its primary and secondary exit ports.

Figure 12:
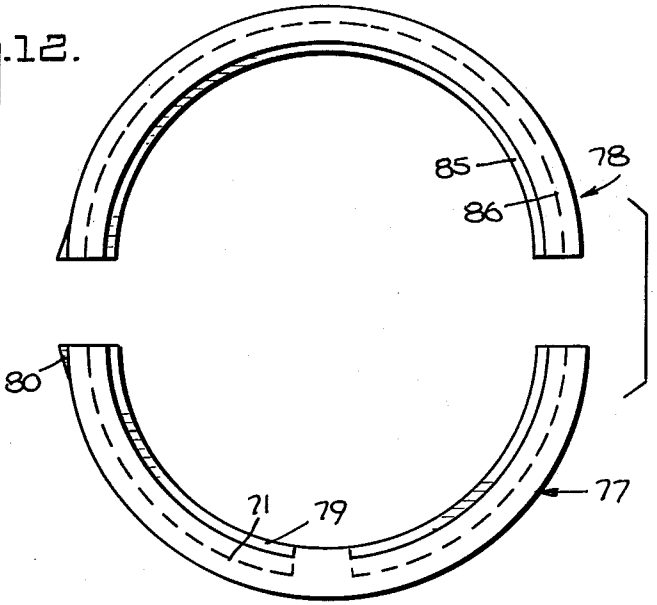
Figure 13:
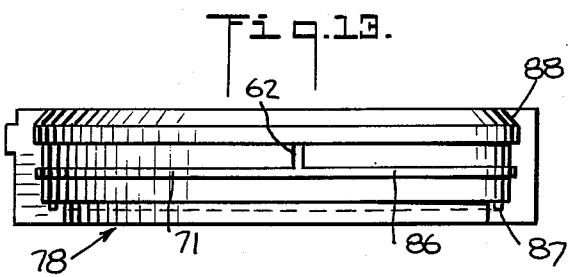
Figure 14:
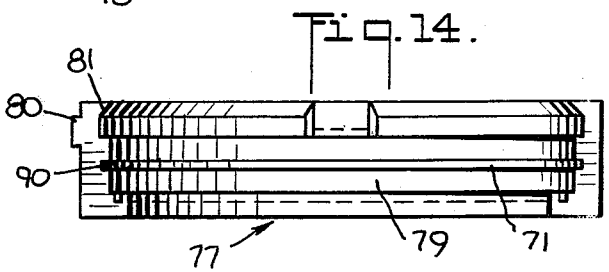

FIGS. 12, 13, and 14 show side and plan views of the exhaust bearing insert, similar in function to the intake insert except that the angles on the pressure plate lock are smaller.

FIGS. 15 and 16 show end and side views respectively of all the major valve pieces assembled. The pressure seal is not shown because it is recessed in the rotor and presses against the inner side of the pressure plates.

Figure 17:
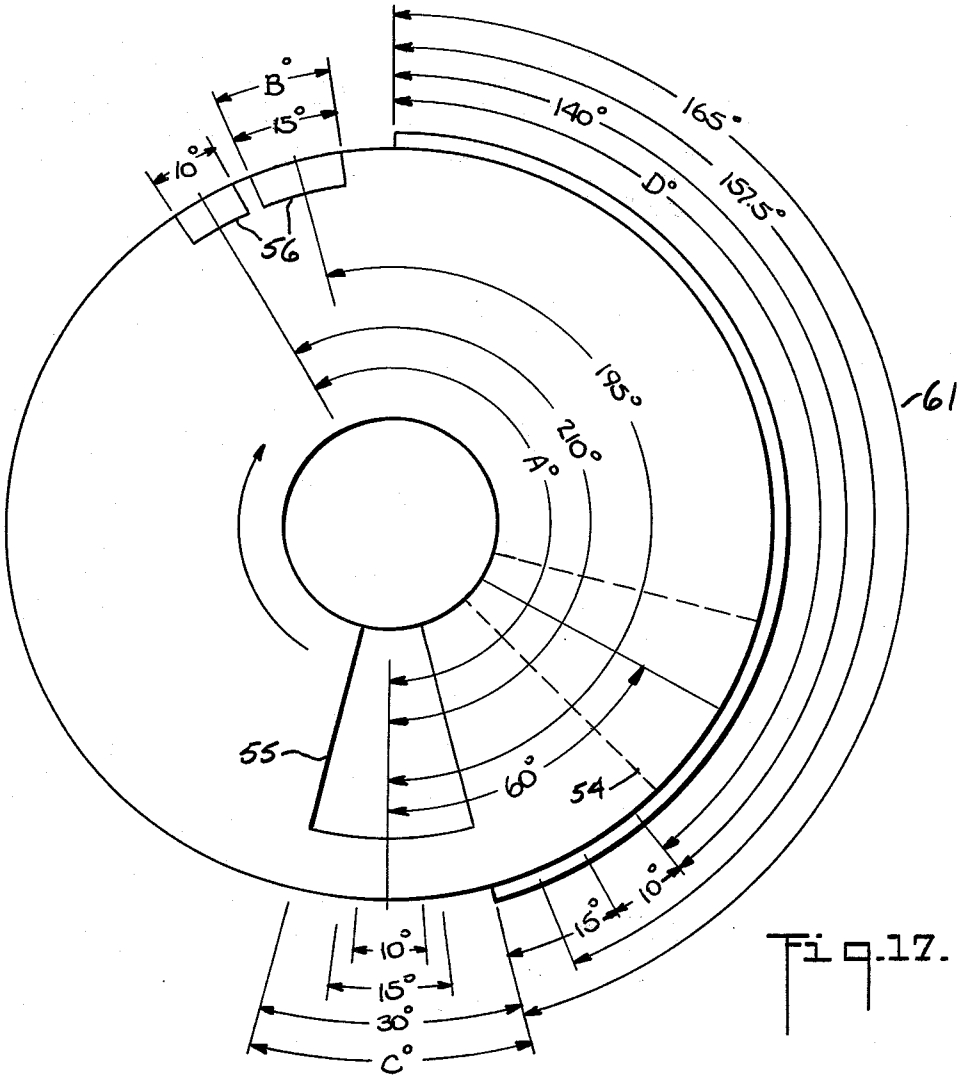

FIG. 17 is a schematic of the exhaust side in the 6 cycle configuration showing the various angles for both the turbocharged system as well as the nonturbocharged system. The figure shows the angles for the oil groove in the ring for both systems and the pressure plate openings angles.

FIG. 18 is a schematic of the intake side in a four cycle stratified charge system according to the invention and the various angles involved.

DETAILED DESCRIPTION OF THE ILLUSTRATED EMBODIMENT

The block is a very simple structure, lays flat, and contains several things.

The block has cylinders 12.

The cylinders 12 are straight through the block 11 and are longer than conventional cylinders because they house two pistons 13 which share the same compression chamber. Thus the total cylinder length of the engine, adding up all the lengths, is approximately one fourth less than a conventional engine where each piston has its own compression chamber.

At the top center of each cylinder wall at the meeting point of the pistons 13 is an opening 14 for the entry and exit of gases.

The block 11 contains mountings for the main journal crankshaft bearings 15. For the four cylinder, eight piston engine shown, there are ten main bearings 15 and for a two cylinder, four piston engine there would be six main bearings 15.

The block also contains a cooling jacket 16 for cooling fluid to circulate around the cylinders 12 and oil galleries 17 to provide passage for oil to the rotary valve arrangement 18. Another gallery on the front goes to pressurize each crankshaft 20 and its bearings 15.

On its upper middle side the block 11 contains recesses 21 for the lower half of the rotary valve 18 (to be described hereafter) and in the recesses 21, grooves for the insertion of the rotary valve bearing inserts 22.

The combustion chamber 23 in the block joins the valve recesses 21 and each cylinder 12.

Spark plug walls 24 open into the combustion chamber 23 and are under the rotary valve 18.

The block 11 also contains mountings for the oil pump and distributor shaft, oil filter, fuel pump, water pump, and rear bearing mount for the idle shaft. The block is part of the housing 70 for the timing gears 25 and is the inner mounting surface for the inner hydraulic pressure plate 26.

The block finally contains intake 103 and exhaust 104 passages and ports. These include the small recycling exhaust passages 105 connecting the intake manifold 39.

A hydraulic pump housing 30 is mounted to one end of the block.

The housing 30 consists of inner 26 and outer pressure plates 31 with their seals,
a middle housing ring 32 or the body of the pump, and
an outer housing 33 that holds the idle gear outer bearing and seal and the two intake and outlet hydraulic pressure ports, 95 and 96 respectively.

The outer housing 33 matches the outer pressure plate 31 that fits the middle housing ring that fits the inner pressure plate 26 that combines with engine block 11. These are all held in position with mounting bolts.

Referring to FIG. 5, an engine shock absorber 97 is connected to the hydraulic pump housing 30 and the oil exit ports 95. The absorber is not absolutely necessary for the engine to run, however, when the engine is applied to a power usage, such as a car, a small vibration will be felt, especially at lower rpms. This is due to the two power strokes to each exhaust stroke of each piston. This syncopation can be eliminated in at least two ways. First, by adding enough cylinders in multipules of 3 times 2, which would either be 6 or 12.

The second way is to even out the power pulses, elmininate noise, and possibly increase engine efficiency by dampening the pulses through an in-line shock absorber 97. It consists of piston 98 on a hydraulic shaft 99 attached to a very strong spring 100. This is located in the hydraulic line at the exit port 95 and when a shock is placed in the line the spring 100 is activated, absorbing this shock; then returning the piston 98 and hydraulic oil back to its starting position.

The damper or shock absorber 97 has a larger out put opening 101 than its input opening 102. This is how it works.

As the two power strokes build up pressure in the hydraulic line the spring 100 will be flexed and the oil will pass through the exit port 95 and into the shock absorber 97. Then the exhaust stroke takes place, pressure in the hydraulic line is reduced, the spring 100 returns the piston 98 and oil to the starting point, the larger output opening 101 in the shock absorber body 97 than the inlet opening 102 preventing oil from returning to the engine reduction gears 40, 41 through the exit ports 95 but maintaining oil pressure to the out put line, thus eliminating the power vibration and keeping even hydraulic oil pressure. This dampening is a constant process under idle or load conditions because the oil is constantly circulating between the two exit and two intake hydraulic ports 95, 96 of the hydraulic body 30.

Two crankshaft covers 34 bolt onto the block sides and gear housing 70.

An oil sump 35 extends below the block 11, the length of the engine. It bolts onto the underside of the block and gear housing 70 and contains drains 17 from the crankcases to the sump 35.

The cover 36 for the rotary valve 18 is a casting and is not a cover in the real sense but an integral part of the valve 18.

A timing gear cover 37 bolts onto the housing 30 and the back top of the valve cover 36.

An exhaust manifold 38 bolts onto the block 11 at each exhaust port and extends over the block and down the back of the engine to one side.

The intake manifold 39 bolts onto the block at the intake ports. The carburetor then bolts onto the intake manifold.

At the rear of the engine there is a reduction gear 40 on each crankshaft 20. These gears are bolted to the crankshafts.

There is a center idle gear 41 matched and timed to the reduction gears 40 on either side of it. This gear 41 contains a recession which enables it to be bolted to an idle shaft 42. The gear ratio between the reduction gears 40 and the idle gear 41 is flexible depending on the rpm and power output wanted for a particular purpose. The design shown assumes a 1.5 to one ratio for suitable hydraulic pressure output and horsepower. The 1.5 to 1 ratio is also the result of the 6 cycle engine sequence. Working together, the idle gear 41 and reduction gears 40 eliminate the need for a flywheel, thus cancelling out the weight gain of the gears.

The idle shaft 42, turning two-thirds the rpm of the crankshafts 40 has the timing gear 25 in front of the idle gear 41.

The bearings that hold this shaft 42 is a double row ball bearing type although a journal type could be used. These bearings whatever type have to be constantly lubricated.

There is a gasket for each crankcase cover 34,
for the oil sump 35, and
for each oil drain 17 from each crankcase cover 34 to the oil sump 35.

The following is the description of the rotary valve 18.

The principle unit of the rotary valve 18 is the rotor. The rotor 50 is located on two hollow shafts or pipes 51, 53 one inside the other with small connecting coolant pipes 52. These connecting pipes 52, one for each rotor, or cylinder of the engine connect the internal pipe 51 with the inside of the rotor 18.

There is one rotor 50 for each cylinder 12.

Referring to FIGS. 6 through 16, each rotor 50 has three ports.

The intake 54 and secondary exhaust 55 ports are of a wedge in shape and 30° in angle. Because the rotor 50 turns at one third the rpm of the crankshafts 20 and the rotor must turn 60° for each stroke of the two pistons the wedges must have this 30° angle. The third port or primary exhaust port 56 is a smaller opening and varies from a 15° opening to a 10° opening depending upon the emission standards set for the engine.

Referring to FIG. 17, each rotor contains these three wedgeshaped ports, or openings; one for the intake stroke, one for the primary exhaust cooling and pressure reduction, and one for the secondary exhaust stroke. The center of the intake opening 54 is 60° behind the center of the secondary exhaust opening 55. Considering a 30° opening for each port, as the pistons complete their secondary exhaust strokes and the exhaust port in the rotor is closed, the intake port opens and the pistons begin their intake strokes.

There is considerable flexability in design of these ports as to size, shape, and aerodynamic quality desired, however, they must be formed in such a way to be rotationally balanced.

The trailing edge of each wedge opening is beveled for lubrication purposes as explained later.

The 6 cycle configuration requires the engine to have the fuel charge fired twice. Without necessarily ascribing to this explanation for the advantages realized in this 6 cycle paired piston engine, the following explanation is offered as one explanation for the advantages achieved.

The 6 cycle engine sequence is possible because the combustion chamber fuel charge is extra rich in relation to the oxygen available, and therefore, the full oxidation of the fuel charge is not completed in the primary combustion, resulting in a relatively cool combustion temperature. The addition of extra oxygen at the end of primary combustion both aids in stopping the combustion process and supplies another potential combustion mixture with the same original fuel charge.

At this full expansion point, after primary combustion of the pistons, a small amount of gas is allowed out of the chamber to stop combustion through decompression and to reduce compression on the next secondary compression stroke. This is done in our rotary valve 18 through a small third port 56 in the exhaust side of the rotor 50. (In the 6 cycle design the main intake 54 and exhaust ports 55 have a 30° opening angle because the rotary valve will rotate at a third of the rpm of the crankshaft.)

At the end of the third cycle, the last 45° turn of the crankshafts, and the beginning of the fourth cycle, an additional 45° turn of the crankshafts 20, the small exhaust port 56 of 15° is open allowing pressure to be reduced and stopping combustion. Then the small exhaust port 56 is completely closed and the cooled gas partially oxidized, at a higher temperature then the original intake mixture, and with adjusted pressure in the chamber is compressed again and fired. All the fuel and oxygen was not used in the primary combustion because of the rapid decompression and expansion of the combustion chamber 23. The secondary combustion then takes place and the sixth stroke, the exhaust stroke, is executed. The process is then repeated starting with the intake stroke.

Combustion should not occur before spark plug ignition and this is where adjustment of the mixture is very important. If the mixture is too lean then there will be too high a primary combustion temperature and preignition is possible upon secondary compression. The high temperature would also create nitrogen oxides. If the mixture is too rich then even on secondary combustion carbon monoxide and hydrocarbon pollutants would result. The mixture should be adjusted with an exhaust gas analyzer.

Where the small exhaust emissions released from the primary combustion go depends upon emission regulations. If emissions regulations are somewhat below 100% clean, possible 80% clean on nitrogen oxides, CO, and hydrocarbons then this primary exhaust can go out the exhaust pipe. In this embodiment it is assumed that the requirements are more strict and this primary exhaust is reducted back into the intake manifold 39.

Figure 4:
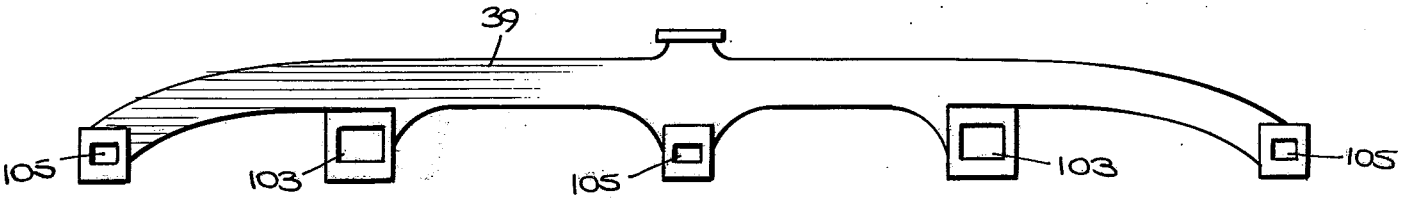
FIG. 4 is a side view of the intake manifold with primary exhaust ports.
Figure 3:
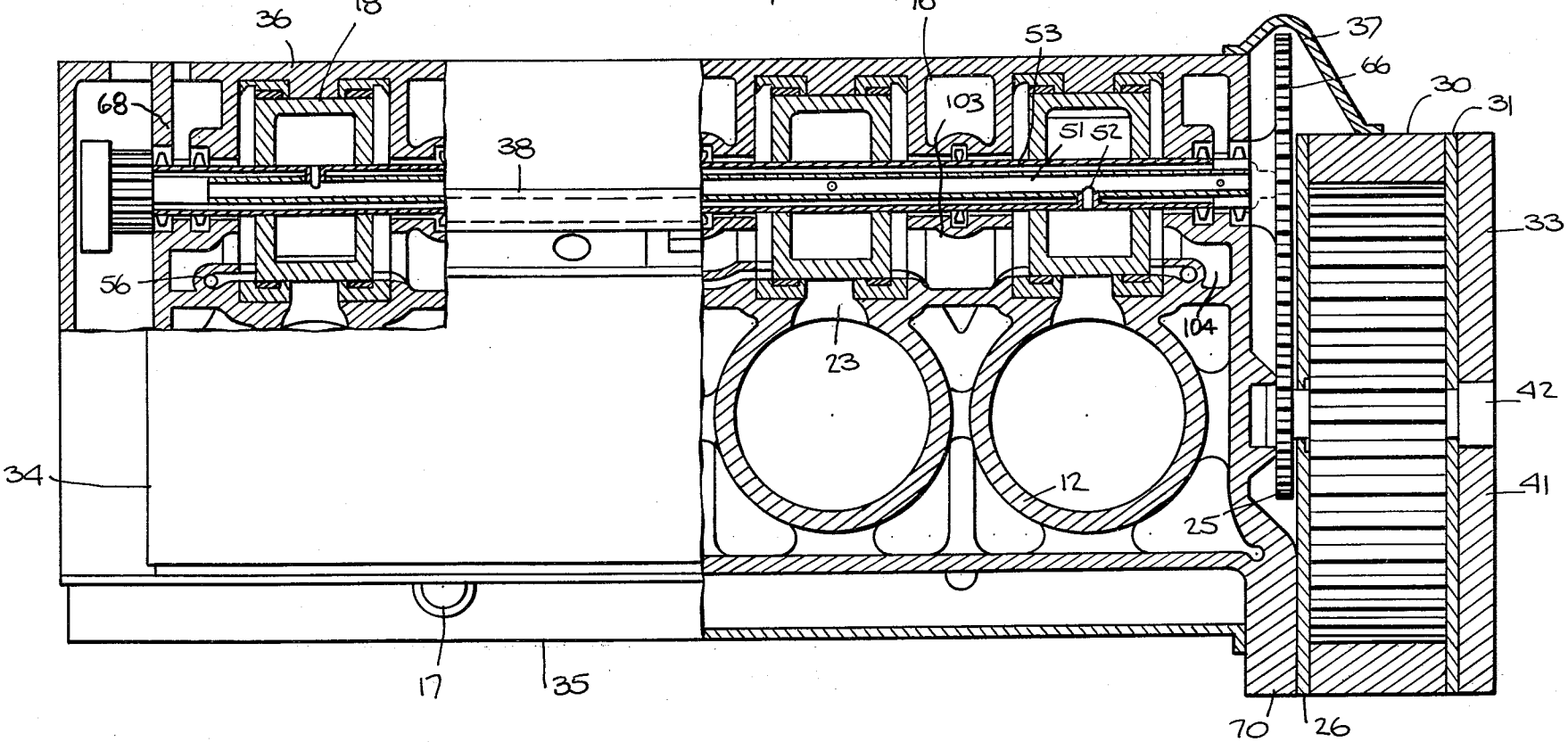

Referring to FIG. 4, the primary exhaust ports 105 are on the same side of the valves at the intake ports 103, and the intake manifold 39.

By timing the engine so that one set of pistons is in the intake cycle while the other set is in the secondary compression cycle this exhaust is transferred through the valves from one cylinder to the other and recycled. It is not very much exhaust but helps in cooling the primary combustion and also cleans up the emission. Also, the valve exhaust opening 56 must be placed on the rotor 50 so that this opening begins at the maximum extension of the crankshafts 20 and ends at a 60 degree turn of the crankshafts. This means the opening of the port 56 is only 10°. These angles are variable and not absolute. It also means that the maximum length of the secondary exhaust port 55 is shortened. The recycling condition is only used in this manner with a two cylinder or a four cylinder engine and not a three cylinder engine.

Figure 1:
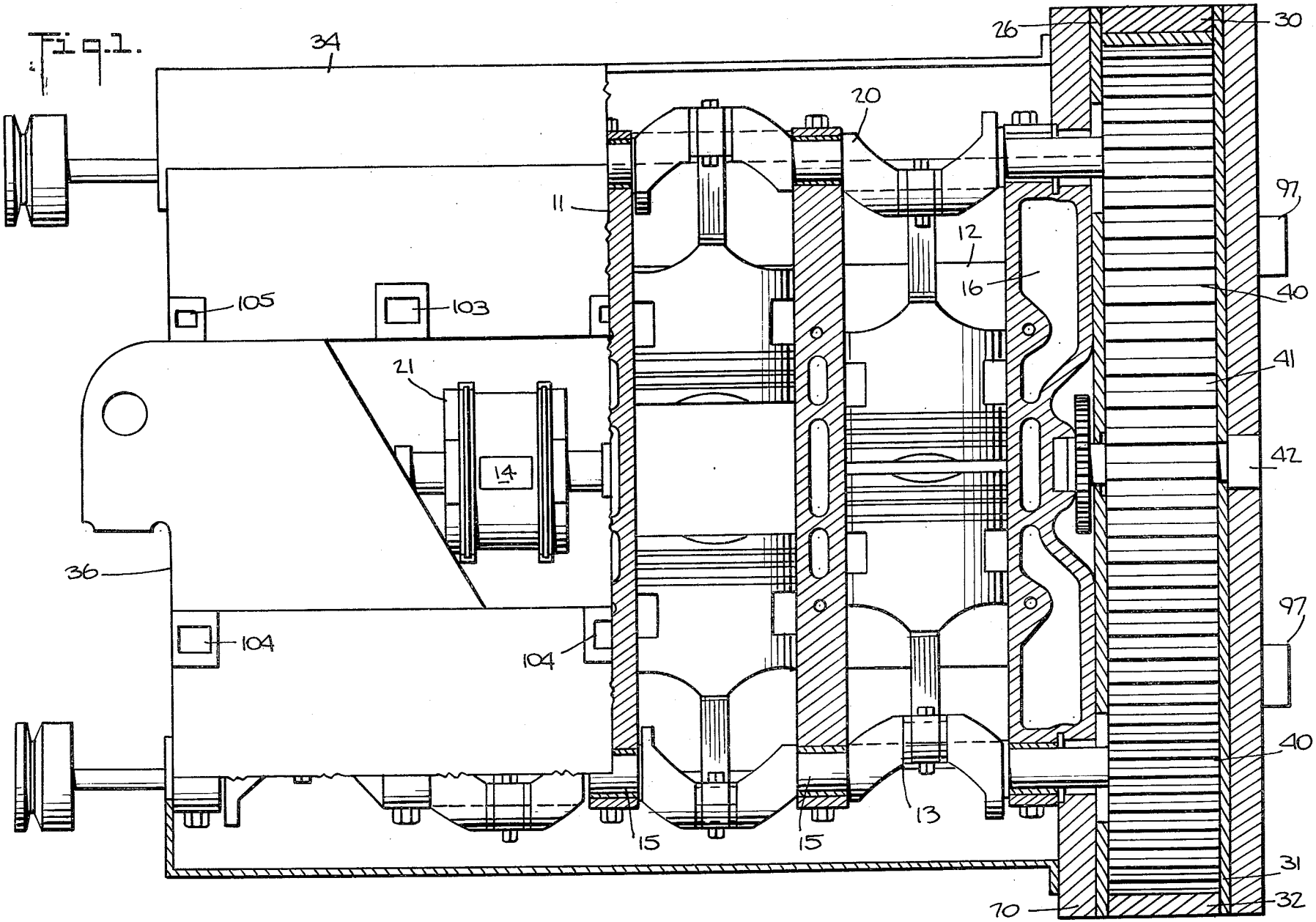
Figure 2:
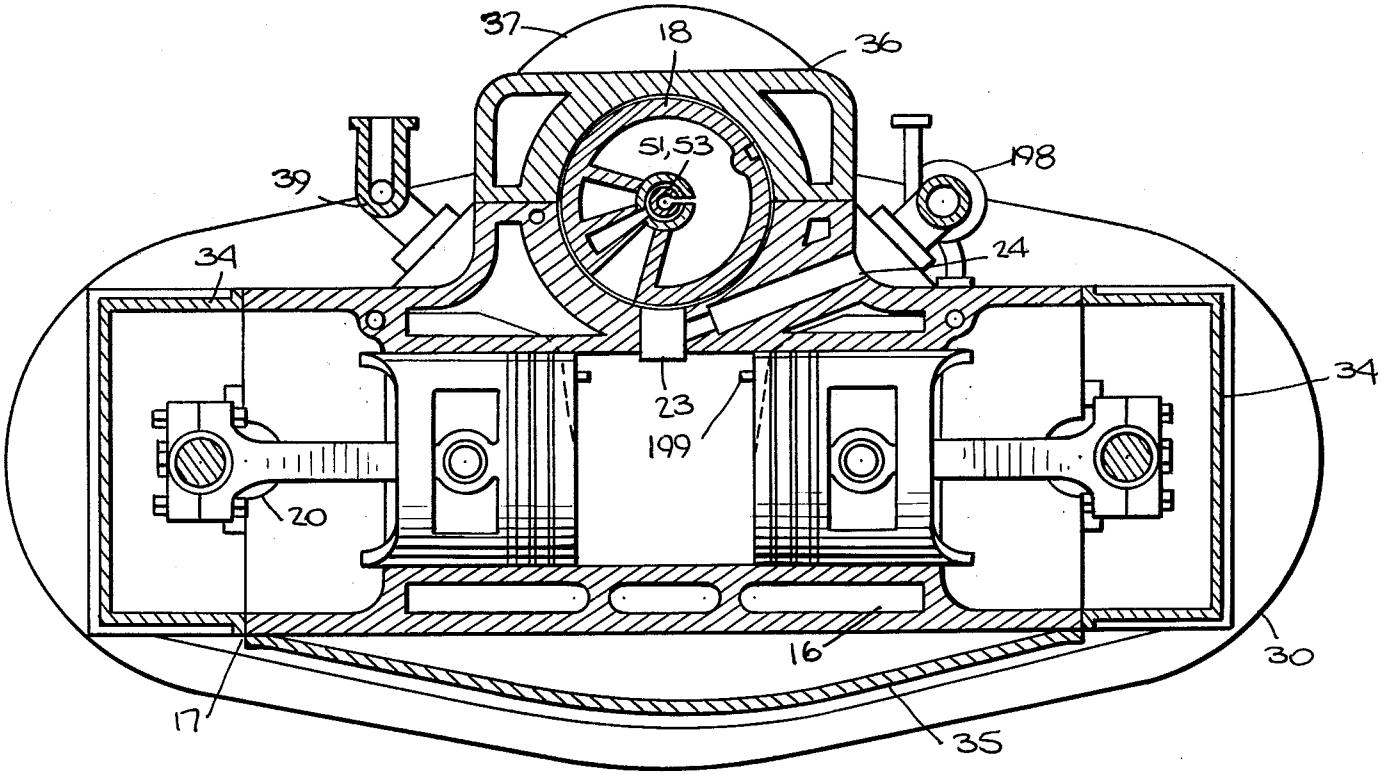

Referring to FIG. 2, by putting small fresh air ports 199, at the maximum extension of the pistons 13 and connecting these ports 199 with a small exhaust driven turbocharger 198 or driven air pump, cold fresh air is introduced into the combustion chamber just before secondary conbustion. The pistons 13 open these ports 199 on every maximum expansion of the combustion chamber which is acceptable whatever the condition, just before primary compression, just before secondary compression and during primary exhaust, or just before secondary exhaust. The recycling of the exhaust or not could still be continued with different mixture adjustment. This fresh air cools the gases for secondary compression and provides additional oxygen for secondary combustion.

A special note of consideration should be directed to the flexability of dwell angle with this engine. This can change with needed requirements of time of full compression with changes in crankshaft angle sequence through the gearing.

Each rotor has two rings 57 and between these rings the rotor is exposed to the combustion violence as it occurs in the burning process. Because of the small corrosive effects on the surface of the rotor it is not designed to touch the valve seats as the rotor turns and is machined a bit smaller than the diameter of the valve seats.

The design of rotary valve 18 considers and compensates for all of the problems of proper cooling, sealing, lubrication, wear, and corrosion. The last four problems are dealt with directly by the use of rotary valve ring 57. The rotary valve ring serves several functions used in conjunection with the rotor 50, becoming part of the rotor. These functions are:

To serve as a bearing surface between the rotating rotor unit 50 and the bearing inserts 72.

To serve as a seal between the combustion chamber and the intake and exhaust ports in the block.

To serve as a lubrication platform for the bearing surface as well as a rotary valve itself for lubrication of the side seat 63, or pressure plate through the use of an oil groove 61, on the side of the ring 57.

To serve as a replaceable wearing surface matched with the proper bearing insert 72.

To hold the surface of the rotor 50 a very small distance away from the valve seats in the block. This prevents wear on the rotor and is one factor in eliminating the rotor unit from seizing due to the small corrosive effects from the exposure to the explosive fire in the combustion chamber as stated before.

Each ring 57 comes in contact on its inner side with an o-ring encased in a small groove 60 on the side of the bearing insert 72.

The ring 57 is circular and is of sufficient thickness and width to avoid any cracking or breaking at any point. The dimensions are limited in thickness and width so that the proper amount of gases pass to and from the combustion chamber.

Each ring 57, two for each rotor 50 on the rotary unit, has a small oil groove 61 on its outer side of a length or arc determined, as follows: The position of the crossover groove 62 in relation to the port opening 64 in the pressure plate 63 must be noted. Then the amount of angle of the port openings 64 are noted along with the position of the bottom of the pressure groove 65 in the pressure plate 63. In addition the third port in the rotor and its position and arc are noted. When these facts are associated in relation to each other, then the angle of arc for the oil groove 61 on the ring 57 can be determined. A schematic of these considerations is shown in FIG. 17. This groove 61 along with its absence in the remaining arc allows oil and its pressure to enter the groove 65 in the pressure plate 63 to lubricate and seal the sides of the rotor and ring and the inner surface of the pressure plate. This groove 61 is limited in length to stop the oil pressure in the pressure plate pressure groove 65 when the port opening in the rotor is opposite this pressure groove. This prevents oil from entering the combustion chamber or exhaust manifold while giving proper lubrication. In the 6 cycle valve the groove is between 157.5° and 165° in length with a possible interruption of 10 degrees.

The two rings 57 on each rotor 50 are placed surrounding the rotor 50 on either side and are placed flush with the sides of the rotor. The position of the ring relative to the oil groove 61 in the ring and the rotor 50 is that one end of the groove 61 be placed at the opposite side of the trailing edge of the port 54 in the rotor. The proper placement of position is important to guarantee proper timing of oil pressure in the pressure groove of the pressure plate.

Each rotor is hollow for the purpose of cooling. This space is connected to the inner space of the rotor shaft 53 which has an inner pipe 52. The whole unit has coolant circulating through it. The bearing surfaces of the rotor are also cooled by tha passage of lubricant over them as well as their contact with the cooled bearing inserts.

The rotary valve unit will be turned by the timing gear 66 attached to its rear end to match the timing gear 25 on the idle shaft. The oil pump and distributor shaft are turned by means of a gear attached to the rotor shaft on its front end. The fuel pump cam is also located here.

There are several seals around the rotor shaft.

a. The coolant seals 68 two on each end of the shaft connect the coolant in the block with the shaft for the internal cooling function.
b. The seals between the cylinders confine leakage of gases around the shaft to that particular function of the side of the cylinder on which the leakage occurs, be it intake or exhaust.

There are two pressure seals in recesses on the rotor sides surrounding the shaft. The purpose of the pressure seal is to prevent oil and gass pressure from entering the intake and exhaust passages in the block. This seal is metal and similar in nature to a piston ring with a metal expander on the inner side, similar in nature and purpose to that of an oil ring on a piston. To show why this seal is necessary a description of the processes involved upon piston compression needs to be expressed.

As the piston compresses the combustion chamber gases, this pressure increases around the rotary valve rotor in the minute space between the block and rotor outer surface. This pressure then enters the rotor ports and exerts itself against the pressure plates 63. Since these plates are held in position with their beveled edges 76 matched to the bearing inserts 72, sealing them in a small tolerance so that there is no binding, it is possible to have a small compression leakage between the pressure plate 63 and the rotor shaft. The pressure seal 75 pressed against the pressure plate and rotor recess prevents this leakage. It also prevents oil from working its way down from the pressure plate and onto the shaft.

The following is a description of the valve seat cast into the top of the block that receives the valve rotor 50.

The seat is connected to each cylinder by a hole 23 that serves as the combustion chamber.

Each seat holds two valve bearing inserts 77.

Each insert is of 180°, has a wide groove 79, machined into it that serves as the bearing surface mating with the ring on the rotor and, contains a lubrication groove 71 machined into the bearing groove.

The inner side of the bearing groove 79 contains an 0-ring 67 to seal in oil from the lubrication groove and prevent it from entering the combustion chamber.

Each insert 77 has a raised wedge 80 on its ' side to act as a lock for its' pressure plate. This wedge also holds a seal in its' inner surface.

Each insert has a beveled mating surface 81 that holds the pressure plates.

Each rotor 50 of the rotary unit has a set of pressure plates 63.

The function of the pressure plate 63 is to completely seal the rotor 50 from gases that travel around the minute space between rotor face, valve seat, and the rotor rings.

These pressure plates are split for installation purposes.

They have lubrication grooves 65. One side of each plate has a pressure groove 65 and the other half of each plate the collection groove 82. The pressure groove 65 connects the crossover groove 62 in the upper bearing insert 78 and the oil return hole 83 in the block sealed with a rubber washer. In the direction of rotation beyond the collector groove 82 but being part of its side is a small wiper 84 that ensures that all the oil in the bevel part of the rotor enters the collection groove. It is of one piece construction and wipes the remaining oil from the rotor before this side is exposed to the intake or exhaust passages in the block. The collector groove 82 is located 30° up from the bottom of the rotor on the intake side so that exhaust pressure moves oil back into the oil return when the intake port is opposite and then when the intake port experiences vacuum the oil comes back into location.

The combined pressure plate has a total of 330° with a 30° opening at the bottom for the passage of intake gases. The exhaust pressure plate has two openings. One large 30° inner port for the secondary exhaust 55 and one smaller 10° or 15° opening for the primary exhaust 56. The intake pressure plate (not shown) is substantially similar to the exhaust pressure plate, except that it does not have the smaller opening.

The outer edges 76 of the pressure plates are beveled to act as horizontal locks and seals upon compression chamber pressurization.

The pressure plate diameter is an important consideration in regard to oil control. The diameter must be a little larger than the diameter of the rotor ring plus the thickness of the oil crossover groove 62 in the upper bearing insert 78. The reason for this is to prevent oil from traveling around the outside of the pressure plate between it and the bearing insert at piston intake periods.

The final part in this total system is the valve head 36. It must be flat in relation to the block surface to which it is bolted.

The valve head is cooled by coolant traveling through cooling ducts.

The valve head also contains the upper valve seal with machined areas for acceptance of the upper inserts 78.

The upper inserts 78 are 180° in shape.

They contain a machined bearing groove 85 and a lubrication groove 86 in the bearing groove.

They contain the provision 87 for the O-ring on the inner side of the bearing groove and the lubrication groove 62 that connects with the pressure plate lubrication groove and the bearing lubrication groove 86.

Each insert 78 has the beveled matching surface 88 that mates with the pressure plate beveled edges and is held tight against its corresponding lower insert 77 with head gasket material in between the contact points of the two halves, sealing the lubrication grooves.

The following is a description of the cooling sequence.

Coolant enters the water pump from the radiator and is discharged from the water pump into the water jacket around the first cylinder.

The coolant then travels through the block toward the rear and passes into the valve head and to the front.

Coolant also traveling into the valve head enters into the rotary valve unit 50 and through it.

The coolant enters through the inner shaft 51.

It then travels into each rotor 50 by small connecting pipes 52 athrough the outer shaft 53.

The coolant then comes from the rotor into the inside of the outer shaft 53 surrounding the inner shaft 57.

The coolant now warmed then flows out of the rotary valve and valve head, through a thermostat and back to the radiator.

The following is a description of the lubrication sequence.

The oil originates in the oil sump 35 and enters an oil screen.

The oil then travels from the screen through the oil pump.

Then the oil comes from the pump into the front crankshaft oil gallery and into the pressurized crankshafts and main bearings.

The oil travels through the crankshafts, connecting rods, and king pins and gack to the sump by way of the crankcase and drains.

Oil also travels from the pump through the valve oil gallery and through the rotary valve oil sequence.

The oil goes from the gallery through the connecting hole 90 in the lower bearing insert 77 and into the lubricating groove 71 in the bearing surface groove 79.

The oil under pressure then travels up into the lubrication groove 86 in the upper bearing inserts 78.

It then enters the small side grooves 62 in the upper valve inserts.

The oil then enters into the long pressure groove 65 in the pressure plate 63 fitting on the side where the rotor is turning upward by way of the small cross over groove.

This oil pressure in the pressure plate pressure groove is interrupted by a lack of a lubrication groove 61 in the side of the ring of the rotor.

The grooves 61 in the ring act as a rotary valve in the oil line causing pressure to be on and off.

This on and off oil pressure in the pressure groove is necessary when the opening of the port in the rotor is opposite the pressure groove in the pressure plate.

When the pressure is off in the groove, oil may run out of pressure groove.

The trailing edge of the port is beveled to act as a wedge to hold the oil against the pressure plate.

This oil is then collected as the rotor turns by a small collection groove 82, in the half of the pressure plate on the downward turn of the rotor. The wiper 84 is part of this groove.

Let is be assumed that the bore on this new engine is the same as that of a conventional engine. Let it also be assumed that the cubic inch displacement per cylinder is the same.

In the new engine there are two pistons working on this same displacement and therefore the stroke of each piston is only half as much. The leverage on the crankshaft then is half as much, because the arm of the crank is only half as long.

In the compression to the maximum peak the force on each piston in the cylinder is the same as in the compression peak of a regular engine since in the new engine each piston not only acts as a compression vehicle but also acts as the cylinder head for the other piston in the cylinder. Upon ignition the same reasoning follows. Each piston in the cylinder receives an equal amount of force as that of a single piston in the cylinder but acting only half the leverage.

Since this is a 6 cycle engine with half the leverage on the crankshaft, the pistons must fire twice to get the same horsepower as a conventional engine and it does so by increasing the rpm of the crankshaft by one third. With a 4 cycle configuration of this engine design the rpm would have to be doubled to achieve equal horsepower. With the 6 cycle sequence the rpm needs to be raised only be one third to achieve equal horsepower.

Following this same reasoning with each cylinder working twice for each intake stroke, the fuel consumption is the same. A consideration on this regard involves the size of the ports of the rotary valve and its comparison to conventional valve openings with the valve as the restriction.

In the conventional stem valve, fluid flow must travel through the opening and around an average 45°bend as well as contend with an opening diameter, valve lift ratio which is approximately 0.2 depending on the cam shaft used and piston valve depressions.

The rotary valve has no such head loss considerations and thus provides easier breathing for the cylinder which is especially needed with the rpm requirements. Not only is the size of the rotary valve opening important to facilitate breathing, but also it is important in determining the exact shape of the slope of the piston face to compensate for the combustion chamber.

There are two other considerations regarding fuel consumption and these concern horsepower to weight ratio and reduction in engine compartment size. This new engine weighs considerably less than a regular engine of equal horsepower.

Between 20 and 25% of the block weight is reduced because two pistons share each cylinder. The reason that it is less than 25% is that bulkheads must be added for the main bearings but here again it depends upon the engine compared. Nevertheless the weight saving on the block is between 20 and 25%.

The weight of the cylinder head can be subtracted subject to the weight of the valve head and block displacement for the lower valve and intake and exhaust port housings.

For a V-8 this would be a minimum of a 50% weight loss for cylinder heads, and a minimum of 50% loss for a straight four cylinder.

The weight loss on the intake manifolds would be 50%.

The weight loss on the exhaust manifolds would be 50%.

The weight loss on the valves would be 50% due to no push rods, rocker arm shafts, rocker arms, lifter, or valves. The cam shaft would weight a little less than the rotary valve unit.

The net result of all these considerations mean that a 30% weight saving is achievable. That is a considerable savings in weight for equal horsepower and increases fuel savings in this regard.

A further consideration involving fuel economy is the reduction in engine compartment size due to the small overall dimensions of the engine. A four cylinder, eight piston engine is only 12 inches high, excluding the air filter. It is 26 inches long, and 19 inches wide.

A two cylinder, four piston engine would be only 16 inches long and with the same height of 12 inches and width of 19 inches. That is a very small engine indeed for its horsepower output and could again save weight in the engine compartment by making it smaller and raising fuel economy further.

Pollution considerations on behalf of the engine depend largely on the valve because it makes possible several different engine configurations. These configurations are largely dependent upon the requirements on pollution percentages. The more stringent the limits, the more complicated and expensive the design.

As was explained above by firing the initial fuel charge twice at low combustion temperature the hydrocarbons and carbon monoxide emissions from the primary combustion are burned in the secondary combustion and at low enough temperatures to prevent nitrogen oxide formation. This can be done in the three steps depending upon requirements.

What I claim is:

1. An internal combustion engine comprising
- a block having a plurality of cylinders therein,
- a pair of pistons having opposed piston heads in each of the cylinders;
- a pair of crankshafts driven by the pistons,
- intake means,
- exhaust means,
- a rotary valve adjacent the cylinders and the intake and exhaust means, comprising rotors having
- intake passages which open the cylinders to the intake means during a portion of the rotation of the rotor corresponding to the intake cycle of the engine,
- exhaust passages which open the cylinders to the exhaust means during a portion of the rotation of rotor corresponding to the exhaust cycle of the engine,
- and second exhaust passages which open the cylinders during a portion of the rotation of the rotor corresponding to a second exhaust cycle of the engine.

2. An engine according to claim 1 in which the rotary valves have
- intake pressure plates on one side of the rotor having intake ports therein through which the rotor intake passages communicate with the intake means, exhaust pressure plates on the other side of the rotors having first exhaust ports through which the rotor exhaust passages communicate with the exhaust means and radially alligned second exhaust ports through which the second exhaust passages communicate.

3. An engine according to claim 1 in which the second exhaust passages open to the exhaust means.

4. An engine according to claim 1 in which the second exhaust passages open to the intake means.

5. An engine according to claim 2 in which the center line of the intake passages and intake ports trail the center line of the exhaust passages and exhaust ports by 60° and the radial angle of the passages and ports is 30°.

6. An engine according to claim 5 in which the center line of the second exhaust passages and second exhaust ports trail the center line of the exhaust passages and ports by 210°, and the radial angle of the second exhaust passages and ports is 10°.

7. An engine according to claim 5 in which the center line of the second exhaust passages and second exhaust ports trail the center line of the exhaust passages and ports by 195° and the radial angle of the second exhaust passages and ports is 15°.

8. An engine according to claim 2 in which each of the pressure plates is comprised of a pair of split members which join together at mating beveled edges along the center line of the ports.

9. An engine according to claim 1 in which the block has air ports leading to the cylinders which open at the maximum extension of the piston to admit a quantity of fresh air to the cylinder.

10. An engine according to claim 1 in which the cylinders are arranged horizontally and the rotary valve is mounted on the block transversely and over the cylinders at about their mid point.

11. An engine according to claim 10 in which a valve head covers the rotary valve and upper bearing means in the valve head and lower bearing means in the block provide bearing means for rotation of the rotor.

12. An engine according to claim 9 comprising turbo charge means for pumping air through the air ports.

13. An internal combustion engine comprising a block having a plurality of cylinders therein;

a pair of pistons having opposed piston heads in each of the cylinders, a pair of crankshafts driven by the pistons intake means, exhaust means, a rotary valve adjacent the cylinders and the intake and exhaust means, comprising rotors having intake passages which open the cylinders to the intake means during a portion of the rotation of the rotor corresponding to the intake cycle of the engine, exhaust passages which open the cylinders to the exhaust means during a portion of the rotation of the rotor corresponding to the exhaust cycle of the engine, and a second intake passage which opens the cylinder during a portion of the rotation of the rotor corresponding to a stratified charge intake cycle of the engine.

14. An engine according to claim 1 comprising means operably associated with said crankshafts for hydraulically dampering the shock of the engine.

15. An engine according to claim 14 in which said crankshafts have gears thereon, comprising a hydraulic pump housing in which said gears are located, said housing having hydraulic oil input and exhaust ports, said hydraulic dampering means being connected to said exhaust ports.

16. An engine according to claim 15 in which said hydraulic dampering means has an input opening connected to the housing exhaust port and a larger output opening connected to other portions of the hydraulic system.

* * * * *